US005225963A

United States Patent [19]

Smart

[11] Patent Number: 5,225,963

[45] Date of Patent: Jul. 6, 1993

[54] ELECTRIC SWITCH LOCKING PLATE DEVICE

[76] Inventor: E. Paul Smart, 918 N. 18th, Grand Forks, N. Dak. 58203

[21] Appl. No.: 809,793

[22] Filed: Dec. 18, 1991

[51] Int. Cl.[5] ..... H01H 9/28

[52] U.S. Cl. ..... 361/357; 70/DIG. 30; 200/43.15

[58] Field of Search ..... 361/331, 357, 380, 376; 74/520, 523, 525, 528, 536, 559, 567; 174/66, 67; 70/162, 164, DIG. 30, DIG. 34, DIG. 56; 200/50 A, 553, 43.01, 43.11, 43.15, 43.16, 43.14, 43.19, 43.21, 43.22, 321, 322, 401

[56] References Cited

U.S. PATENT DOCUMENTS

| | | | |
|---|---|---|---|
| 4,102,471 | 7/1978 | Lori | 220/242 |
| 4,347,412 | 8/1982 | Mihara | 70/DIG. 30 |
| 4,873,404 | 10/1989 | Fritsch | 200/332 |
| 4,882,456 | 11/1989 | Hovanic et al. | 200/43.15 |
| 4,978,816 | 12/1990 | Castonguay | 70/DIG. 30 |
| 5,077,452 | 12/1991 | Mathers | 200/43.01 |
| 5,079,390 | 1/1992 | Costanzo | 200/43.14 |

OTHER PUBLICATIONS

Security Key Lock, Western Electric, Tech Dig. No. 32, Oct., 1973, Kasyan, p. 25.

*Primary Examiner*—Gerald P. Tolin
*Attorney, Agent, or Firm*—Robert E. Kleve

[57] ABSTRACT

The invention comprises a locking plate device for attachment to opposite sides of a electrical breaker switch to prevent accidental movement of the breaker switch from an "Off" to an "On" position. The plate device has a U shaped metal plate with parallel flanges extending from its apex and with the parallel flanges adapted to be placed on opposite sides of the breaker switch and on top of the breaker switch housing. A threaded rod extends through the flanges with a lock nut threaded onto one end and the nut engaged against the outside of one flange, and with an enlarged head on the threaded rod engaging the outside of the other flanges whereby rotation of the screw in one direction will draw the lock nut and one flange toward the other flange to adjust the flanges toward the sides of switches with smaller widths. The plate has a lever arm pivotally mounted on the threaded rod. Cam surfaces are provided on the lever arm near the pivot point of the arm to engage cam surfaces provided on the flange adjacent the arm cam surfaces by rotation of the lever arm whereby the rotation of the lever arm causes the lever arm cam surfaces to engage the flange cam surfaces and cam the one flange of the U plate toward the other flange of the U plate to cause the flanges to move further toward one another to grip and lock the breaker switch between the flanges to prevent its accidental movement from an "Off" to "One" position.

3 Claims, 1 Drawing Sheet

ELECTRIC SWITCH LOCKING PLATE DEVICE

This invention relates to switch locking apparatus, more particularly, the invention relates to locking devices for locking out electrical control switches to prevent their being accidentally turned on.

It is object of the invention to provide a novel device to lock out the switch of electric circuit breakers to prevent the switch from accidentally being turned on.

It is another object of the invention provide a novel locking device for locking an electrical switch to prevent its movement, which device has a novel lever which cams side panels against the switch to prevent its movement.

It is another object of the invention to provide a novel lever operated locking plate which can lever structure against the switch to prevent it movement.

Further objects and advantages of the invention will become apparent as the description proceeds and when taken in conjunction with the accompanying drawing wherein

DESCRIPTION OF A PREFERRED EMBODIMENT

Briefly stated, the invention comprises a locking plate device for attachment to an electric switch having a housing with a pivotally mounted switch actuator mounted to its top with said switch having an elongated rod or switch actuator projecting out of the top of the housing and pivotally mounted within the housing to move from an "Off" position to an "On" position; said plate having a U-shaped metal panel with a pair of flanges extending from the ends of the U-shaped portion with their other ends being free, said flanges having sufficient resiliency to flex about the apex toward and away from one another, said plate being adapted to be positioned on the switch housing with the switch actuator positioned between the flanges of the locking plate, said switch a screw extending through the flanges, a lever pivotally mounted on the screw, complementary cam means on one of the flanges and on the lever adjacent the screw, whereby pivoting of said lever moves said lever cam surfaces against said cam surfaces of the one flange and cams the one flange of the locking device toward the other of said flanges whereby said switch rod or breaker switch between said flanges will be frictionally engaged by said flanges to prevent accidental movement.

Figure 2:
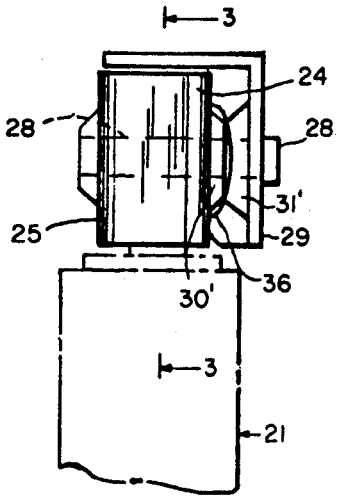
FIG. 2 is an end view of the locking plate mounted on top of of the switch mechanism in a locked position as shown in FIG. 1.
Figure 1:
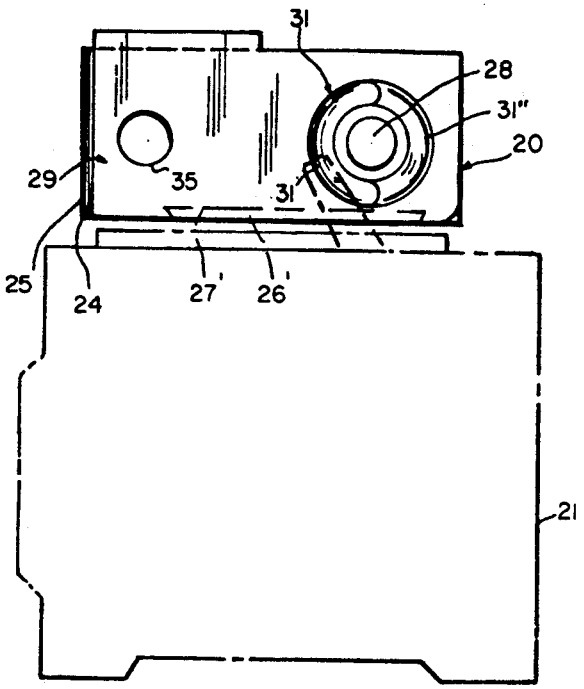
FIG. 1 is a side elevational view of the electrical switch locking plate, shown attached to the top of an electric switch housing to engage the sides of an electric switch to prevent its movement, with the lever to engage the locking action for the plate shown in phantom lines in several positions moving toward its locking position, with the lever shown in solid lines in its locked position.

Referring more particularly to the drawing, in FIG. 1, the locking plate device 20 is illustrated mounted on top of the housing 21' of an electric switch 21. The switch is of a conventional type having a pivotally mounted breaker switch actuator 23 of an elongated shape extending out of the top of the housing 21' and pivotally mounted within the housing to pivot from a slanted position as illustrated in the drawing in solid lines in FIG. 1 for an "Off" position to an opposing slanted position for an "ON" position.

The locking plate 20 has its plate 24 with a U-shaped apex portion 25 with a pair of flanges 26 and 27 extending from opposite ends of said apex in parallel relation with the outer ends 26' and 27' of the flanges being free. The plate 24 is made of metal with sufficient resiliency to be moved toward the sides of switch actuator 23 by leverage but able to spring back to its original position upon removal of the leverage. A a threaded rod or screw 28 extends freely through bores in the flanges 26 and 27. A lever 29 is pivotally mounted on the rod 28. Complimentary cam surfaces 30 and 31 are on the flange 27 of the update and lever arm 29, respectively and circle about the rod 28. The circular cam surface 30 of the flange 27 of U-plate 24 circles about screw 28 and extends or projects in one direction on one portion 30' of the circle and projects in the opposite direction in the opposing portion 30'' of the circle. Similarly the cam surface 31 on the lever arm circles about the rod 28 and projects in one direction on one portion 31' of the circle and projects in the opposite direction in the opposite portion 31'' of the circle.

A mylar washer 36 is mounted on the threaded rod 28 between the cam surfaces of the lever arm 29 and the cam surfaces of the flange 27 to prevent the cam surfaces from binding one another and so that they easily slidably engage one another. The flanges 26 and 27 each have inturned lower edges 26' and 27' which engage against the sides of the switch actuator 23 to lock the plate from moving upward relative to the switch actuator and switch housing 21' when viewed from FIG. 3. The flange 26 has a downwardly pointed end 37 which projects downward into the opening 38 in the housing 21' for the switch actuator 23 and the pointed end 37 engaged against the rear edge 38' of the opening in the housing to prevent the plate 20 from moving rearward or from left to right relative to the housing 21' when viewed from FIG. 3.

The front 37'' of the pointed end 37 engages against the rear surface of the switch actuator 23 to prevent forward movement of the plate 20 relative to the housing 21'.

Operation

Figure 4:
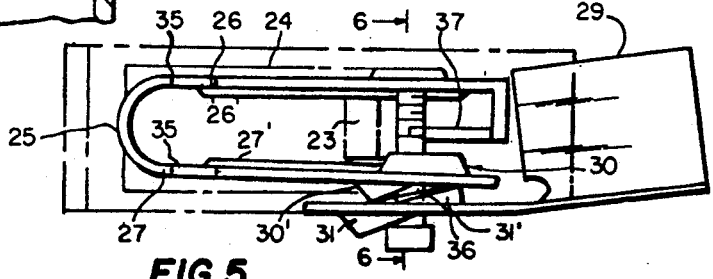
FIG. 4 is a top plan view of the locking device after the lever has been pivoted to the left to a locked position.
Figure 6:
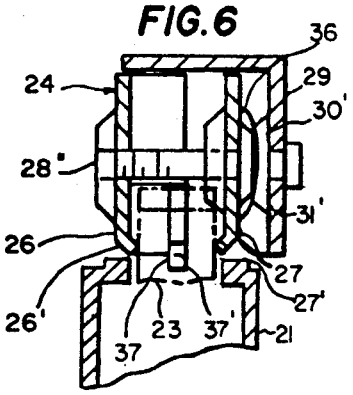
FIG. 6 is a cross-sectional view taken along line 6—6 of FIG. 4.
Figure 5:
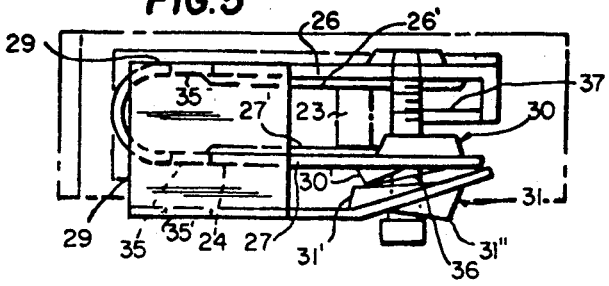
FIG. 5 is a side elevational view of the locking plate device.

The locking plate 20 will be slid over the top of the switch actuator 23, with the flanges 26 and 27 on each side of the switch actuator 23, as illustrated in FIGS. 1 and 4. The plate 20, when slid over the top of the switch actuator 23, will have the lever 29 pivoted to its open released position as illustrated in FIG. 4, so that the inturned lower edges 26' and 27' of the flanges 26 and 27 may slide down horizontally beside the outer edges of the switch actuator 23 without their grasping the actuator 23. Once the plate has been positioned on the housing and switch actuator, with the flanges lower edges 26' and 27' on each side of the switch actuator 23, the operator will pivot the lever 29 counter clockwise, from its position shown in solid lines in FIG. 4 to its position shown in solid lines in FIG. 1 and its position shown in FIG. 5. The pivoting of the lever 29 counterclockwise pivots the cam surfaces 31 on the lever counterclockwise from its position shown in FIG. 4 to its position shown in FIG. 5, causing the cam surfaces 31' on the lever 29 to engage the cam surfaces 30' on the flange 27 thereby forcing the flange 27 toward flange 26, as shown in FIG. 5. This causes the inturned lower edges 26' and 27' of the flanges to engage against the sides of the switch actuator 23 to prevent upward movement of the plate 20 relative to the housing 21' and switch 23. The mounting of the plate 20 over the switch actuator 23 and housing also places the pointed end 37 of flange 26 in the opening 38 and prevents forward or rearward movement of the plate relative to the housing and switch 23 and thereby prevents movement of the switch actuator pivotally relative to the housing 21', and thereby locks the switch actuator in its position, which would be an "Off" position and prevents it from being accidentally turned on.

The rod 28 is threaded with a locking washer and nut 28'' at one end of the rod with the nut threaded onto the rod or screw 28. An enlarged head 28' is fixed at the other end of the screw whereby the screw may be rotated by the head to thread the screw further into the nut 28''' while the locking washer prevents the nut from turning , and the lever 29 being pivotally mounted on the screw its pivotal movement will not normally cause the screw to rotate. The rotation of screw 28 relative to the nut draws the flanges 26 toward or away from one another enabling the flanges to be adjusted in their space to one another to adjust to the varying width of the the breaker switches actuators of different makes of switches so that the flanges will be sufficiently close to the sides of the switch actuator to enable the further caming of the flange 27 toward the flange 26 by the rotation of the lever 29 to cause the flanges 26 an 27 to firmly grasp the sides of the switch actuator of varying width.

Figure 3:
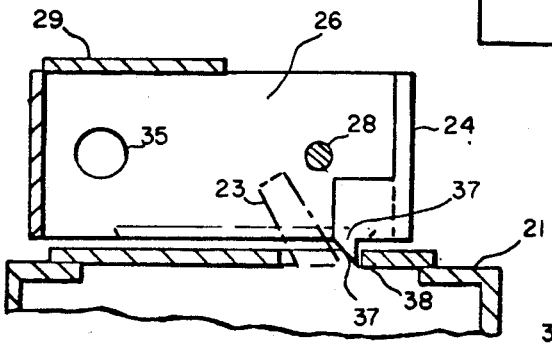
FIG. 3 is a top plan view of the locking plate device shown mounted to the top of a switch mechanism, with the lever about to be pivoted to the left toward its locked position.

A bore 35 extends through the flanges 26 and 27 and a bore 35' extends through the flange portion of the lever 29 so that when the lever has been pivoted about screw 28 to its locked position shown in solid lines in FIGS. 1 and 3, a tag may be extended through the holes or the locking arm of a padlock may be extended through the holes to lock the lever 29 to the plate 24 to prevent the movement of the handle or lever 29 relative to the plate and thereby lock the plate 24 to the breaker switch actuator 23.

It will be obvious that various changes and departures may be made to the invention without departing from the spirit and scope thereof, and accordinly, it is not intended that the invention be limited to that specifically described in the specification or as illustrated in the drawings, but only as set forth in the appended claims wherein,

What is claimed is:

1. A locking device attached to an electrical switch having a housing with an elongated breaker switch actuator extending outward through the top of the housing and pivotally mounted to the housing to pivot from an "Off" to an "On" position comprising: a U shaped plate of resilient material having parallel flanges with an apex portion and with the parallel flanges extending from opposite ends of the apex; said plate being placed on the switch housing with the flanges on opposite sides of the breaker switch actuator; a threaded rod extending through the flanges of the U plate with lock nut means on one of the flanges and the rod threaded into the lock nut means and the other end of the rod engaged against the other flange whereby rotation of the rod will thread the rod into the lock nut means drawing the lock nut means against the one flange and drawing the one flange of the U plate toward the other flange of the U plate to adjust the space between the flanges to place the flanges closer to one another for engagement with breaker switch actuators with smaller widths; said U plate having a lever arm means pivotally mounted to said rod; said lever arm means having cam surface adjacent one of the flanges of the U plate and said one of said flanges having cam surfaces whereby rotation of the lever arm will cause its cam surfaces to engage the cam surfaces of the one flange of the U plate and urge it toward the other flange of the U plate to cause the flanges to grip the breaker switch actuator therebetween and lock it from movement relative to the plate, with the plate engaging the switch actuator in a manner to be locked against movement relative to the switch.

2. A locking device attached to an electrical switch having a housing with an elongated breaker switch actuator extending outward through the top of the housing and pivotally mounted to the housing to pivot from an "Off" to an "On" position comprising: a U-shaped plate of resilient material having parallel flanges with an apex portion and with the parallel flanges extending from opposite ends of the apex portion; said plate being placed on the switch housing with the flanges on opposite sides of the breaker switch actuator; threaded rod first adjustment means extending across and connected to both of said flanges of the U plate and threadably adjustable to draw the flanges toward and away from one another to adjust the flanges to be near the opposite sides of breaker switch actuators of varying widths; a lever arm comprising second adjustment means mounted on the threaded rod first adjustment means and engageable against one of the flanges to move one of the flanges further toward the other of the flanges to adjust the flanges from a position near the opposite sides of the breaker switch actuator to a position gripping the breaker switch actuator from opposite sides to prevent movement of the breaker switch actuator relative to the switch and plate.

3. A locking device attached to an electrical switch having a housing with an elongated breaker switch actuator extending though an opening in the top of said housing and pivotally mounted about a lateral axis to the housing to pivot from an "Off" to an "On" position comprising: a U-shaped plate of resilient material having parallel flanges with an apex portion with the parallel flanges extending from opposite ends of the apex portion; said plate being placed on the top of the housing with the flanges of the U plate on opposite sides of the breaker switch actuator and perpendicular to the pivotal axis of the actuator; first adjustment means extending across and to connected to both of said flanges to adjustable limit the space between the flanges; a lever adjustment means mounted on the first adjustment means and further adjusts the flanges from a position near the opposite sides of the actuator along the lateral axis toward the actuator from opposite sides to grip the actuator from opposite sides to prevent movement of the switch actuator relative to the plate; means projecting from the plate laterally of the axis to engage the housing to prevent the plate from moving laterally of the axis in at least one direction.

* * * * *